US010973738B1

(12) United States Patent
Tronson

(10) Patent No.: US 10,973,738 B1
(45) **Date of Patent: *Apr. 13, 2021**

(54) SIMULATED AREOLA NIPPLE COMPLEX

(71) Applicant: Presque, Inc., Woodside, CA (US)

(72) Inventor: Soody Tronson, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/374,945

(22) Filed: Apr. 4, 2019

Related U.S. Application Data

(63) Continuation of application No. 15/868,917, filed on Jan. 11, 2018, now Pat. No. 10,285,911, which is a continuation of application No. 15/437,131, filed on Feb. 20, 2017, now Pat. No. 9,895,292, which is a continuation of application No. 15/154,881, filed on May 13, 2016, now Pat. No. 9,610,226, which is a continuation of application No. 14/696,131, filed on Apr. 24, 2015, now Pat. No. 9,364,398, which is a continuation of application No. 13/840,953, filed on Mar. 15, 2013, now Pat. No. 9,060,917, which is a continuation-in-part of application No. 13/646,722, filed on Oct. 7, 2012, now abandoned.

(60) Provisional application No. 61/543,921, filed on Oct. 6, 2011.

(51) Int. Cl.

| | |
|---|---|
| ***A61J 9/00*** | (2006.01) |
| ***A61J 13/00*** | (2006.01) |
| ***A61J 11/00*** | (2006.01) |
| ***A61J 17/00*** | (2006.01) |
| ***A61J 9/06*** | (2006.01) |
| ***A41C 3/04*** | (2006.01) |

(52) U.S. Cl.
CPC ..... *A61J 9/0676* (2015.05); *A41C 3/04* (2013.01); *A61J 9/00* (2013.01); *A61J 9/005* (2013.01); *A61J 9/0607* (2015.05); *A61J 9/0638* (2015.05); *A61J 11/00* (2013.01); *A61J 11/005* (2013.01); *A61J 11/0005* (2013.01); *A61J 13/00* (2013.01)

(58) Field of Classification Search
CPC ... A61J 11/0005; A61J 13/00; A61J 2017/006
USPC ..... 224/148.1–148.7; 450/37; 604/74; 606/236
See application file for complete search history.

(56) References Cited

U.S. PATENT DOCUMENTS

| | | | | | |
|---|---|---|---|---|---|
| 1,985 | A * | 2/1841 | Windshin | A61J 9/04 | 215/11.5 |
| 751,415 | A * | 2/1904 | Prindle | A61J 13/00 | 128/890 |
| 2,364,866 | A * | 12/1944 | Meynier, Jr. | A61J 13/00 | 128/890 |
| 2,543,499 | A * | 2/1951 | Kausch | A61F 2/52 | 623/7 |
| 2,891,544 | A * | 6/1959 | London | A61F 13/141 | 604/379 |
| 3,144,230 | A * | 8/1964 | Brooks | A61J 9/0638 | 248/102 |
| 3,197,099 | A * | 7/1965 | Doba | A61J 9/0676 | 224/148.4 |

(Continued)

*Primary Examiner* — Justin M Larson
(74) *Attorney, Agent, or Firm* — STLG Law Firm; Soody Tronson

(57) ABSTRACT

Briefly, a feeding device embodying features of the present invention approximately conforms to the shape of a human breast and includes at least one housing for storing fluid coupled to a dispensing portion having an apertured dispensing tip for delivering the fluid to an infant.

9 Claims, 6 Drawing Sheets

(56) References Cited

U.S. PATENT DOCUMENTS 3,977,638 A * 8/1976 Woodard ..... A61J 9/0676 248/102
4,220,302 A * 9/1980 Hampton ..... A61J 9/0676 224/148.6
4,270,538 A * 6/1981 Murphy ..... A61M 1/064 450/37
D264,993 S * 6/1982 Kestenberg ..... D24/198
4,713,842 A * 12/1987 Patterson ..... A41D 1/205 2/104
4,776,546 A * 10/1988 Goldson ..... A61J 9/00 224/148.4
4,965,888 A * 10/1990 Jones ..... A61J 9/00 2/104
D321,058 S * 10/1991 Dickinson ..... D24/207
5,086,517 A * 2/1992 Jones ..... A61J 9/00 2/104
5,397,039 A * 3/1995 Parcelles ..... A45F 5/00 224/148.5
5,421,496 A * 6/1995 Korsinsky ..... A61J 11/0005 215/11.1
5,474,193 A * 12/1995 Larsson ..... A61J 9/00 215/11.4
5,573,153 A * 11/1996 Stillman ..... A61J 9/0676 224/148.6
5,582,335 A * 12/1996 Beard ..... A61J 9/0661 215/11.6
5,683,286 A * 11/1997 Kielland ..... A61F 13/141 2/267
5,690,679 A * 11/1997 Prentiss ..... A61J 9/00 215/11.6
5,897,580 A * 4/1999 Silver ..... A61F 7/03 128/889
6,241,575 B1 * 6/2001 Shailer ..... A41C 3/105 2/69
6,270,519 B1 * 8/2001 Botts ..... A61J 7/0046 215/11.1
6,398,088 B1 * 6/2002 Burke ..... A47D 13/025 224/148.6
6,669,064 B2 * 12/2003 Perricone ..... A61J 9/001 215/11.3
6,681,944 B1 * 1/2004 Youssef ..... A61J 9/005 215/11.1
6,962,519 B1 * 11/2005 Clark ..... A61J 13/00 450/37
7,048,160 B2 * 5/2006 Anderson ..... A47D 13/02 224/148.6
7,175,502 B2 * 2/2007 Clark ..... A61J 13/00 128/889
7,351,251 B2 * 4/2008 Garrett ..... A61J 17/001 606/236
7,386,902 B2 * 6/2008 Wilson ..... A47G 9/10 248/102
D576,283 S * 9/2008 Marshall ..... D24/198
D584,399 S * 1/2009 Pacini ..... D24/109
7,552,734 B2 * 6/2009 Adams ..... A01K 7/00 128/847
7,559,915 B2 * 7/2009 Dao ..... A61M 1/06 450/36
7,621,797 B1 * 11/2009 Hershkovich ..... A41C 3/04 450/36
8,357,117 B2 * 1/2013 Sokal ..... A61J 7/0053 426/85
8,460,233 B2 * 6/2013 McCoy ..... A61J 13/00 604/74
8,469,771 B2 * 6/2013 Francis ..... A61J 13/00 450/37
9,060,917 B1 * 6/2015 Tronson ..... A61J 9/00
9,149,414 B1 * 10/2015 Zawahry ..... A61J 9/0676
9,364,398 B1 * 6/2016 Tronson ..... A61J 9/00
9,610,226 B1 * 4/2017 Tronson ..... A61J 9/00
9,895,292 B1 * 2/2018 Tronson ..... A61J 9/00
9,925,122 B2 * 3/2018 Chin ..... A61J 7/0015
10,285,911 B1 * 5/2019 Tronson ..... A61J 9/00
10,290,372 B2 * 5/2019 Chin ..... G16H 20/13
2003/0150890 A1 * 8/2003 Perricone ..... A61J 11/005 224/148.6
2004/0164107 A1 * 8/2004 Anderson ..... A61J 9/0638 224/148.6
2004/0164108 A1 * 8/2004 Anderson ..... A61J 9/0676 224/148.6
2004/0182813 A1 * 9/2004 Gilmore ..... A61J 11/005 215/11.4
2005/0059927 A1 * 3/2005 Buiatti ..... A61J 13/00 604/74
2005/0103954 A1 * 5/2005 Touma ..... A61J 9/0638 248/103
2006/0157065 A1 * 7/2006 Rohrig ..... A61J 13/00 128/890
2008/0172771 A1 * 7/2008 Adamson ..... A41C 3/04 2/104
2009/0166481 A1 * 7/2009 Chen ..... A61J 9/0607 248/102
2009/0194116 A1 * 8/2009 Pacini ..... A61J 13/00 128/890
2009/0261054 A1 * 10/2009 Shelby ..... B65D 75/5872 215/11.3
2009/0286452 A1 * 11/2009 Grayson ..... A41C 3/04 450/36
2010/0258519 A1 * 10/2010 Shelby ..... A61J 9/005 215/11.3
2012/0165729 A1 * 6/2012 Cudworth ..... A61J 13/00 604/74
2013/0048671 A1 * 2/2013 Braly ..... A45F 3/20 222/129
2013/0126563 A1 * 5/2013 Henry ..... A61J 9/0676 224/148.5
2013/0270140 A1 * 10/2013 Tronson ..... B65D 25/00 206/457
2016/0120763 A1 * 5/2016 Conner ..... A61J 13/00 604/76
2019/0060088 A1 * 2/2019 Meikle ..... A61J 9/0676
2019/0228862 A1 * 7/2019 Chin ..... A61J 17/006
2020/0206083 A1 * 7/2020 Scheuerle ..... A61J 13/00
2020/0289376 A1 * 9/2020 Spivak ..... A61J 7/00

* cited by examiner

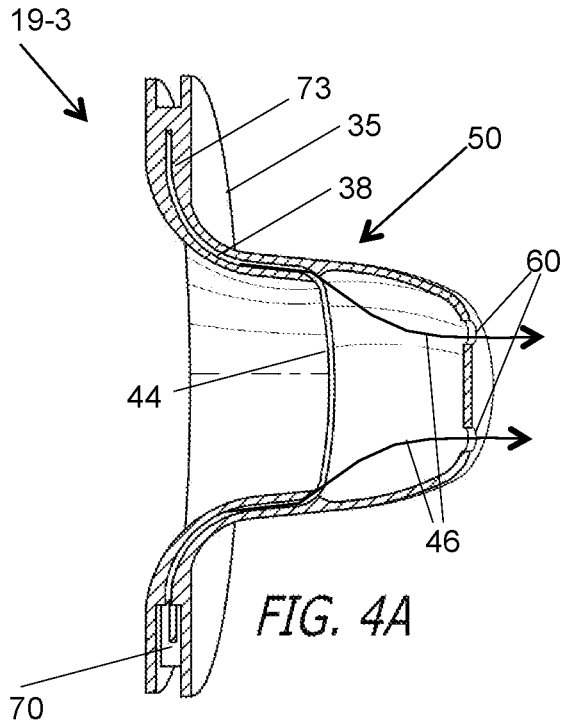
FIG. 4A
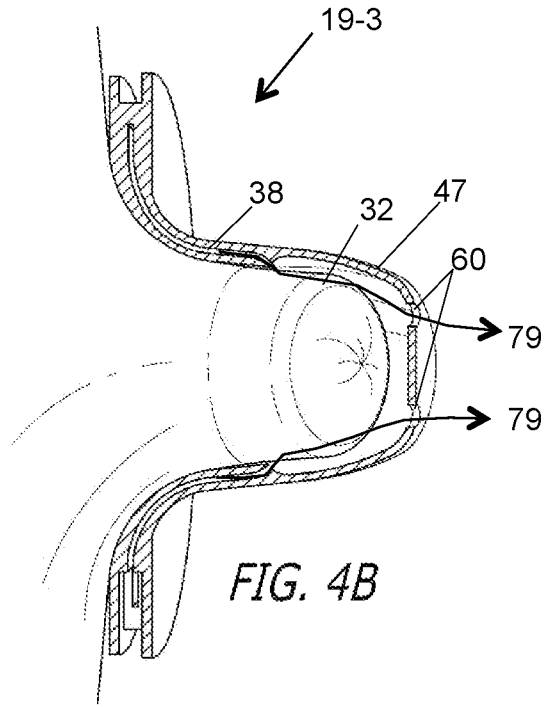
FIG. 4B
FIG. 5
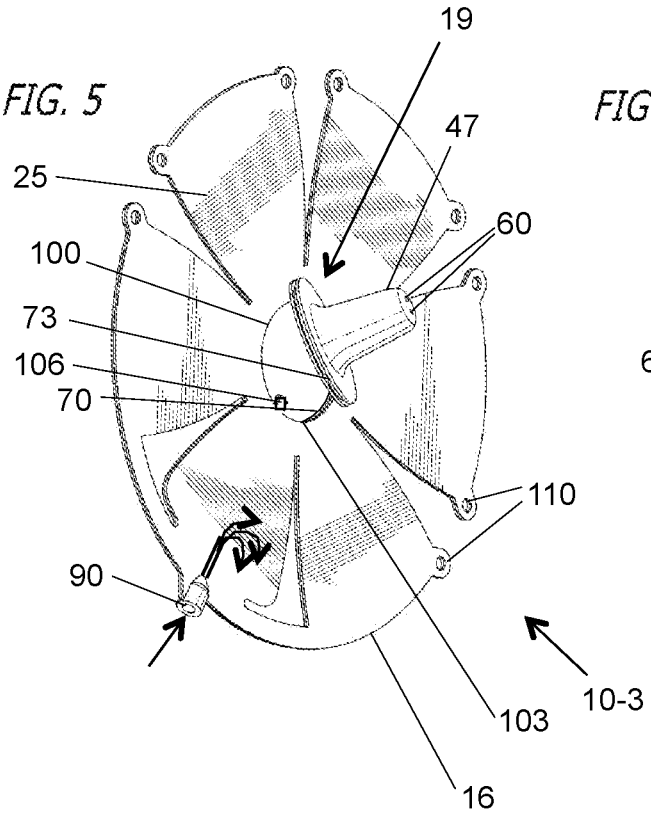
FIG. 6
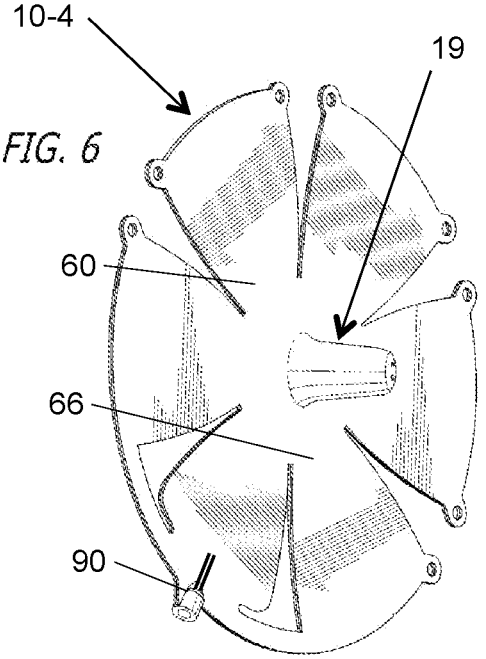

10-5

FIG. 9
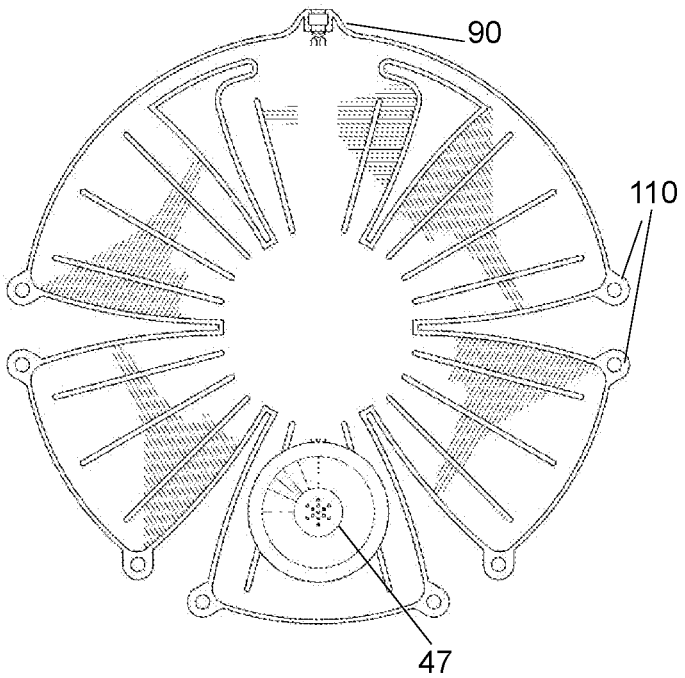
FIG. 10
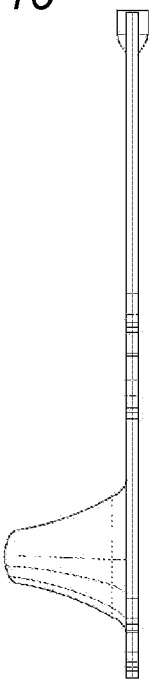
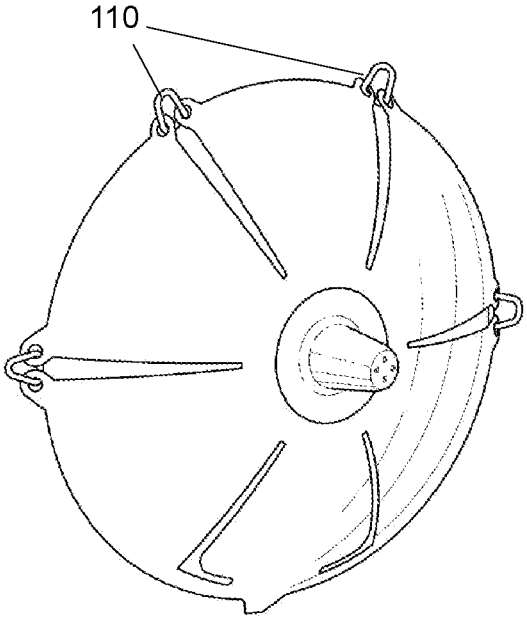
FIG. 11

SIMULATED AREOLA NIPPLE COMPLEX

RELATED APPLICATIONS

This application is a continuation-in-part of and claims priority to U.S. patent application Ser. No. 13/646,722, filed Oct. 7, 2012, which claims priority from U.S. provisional patent application Ser. No. 61/543,921, filed Oct. 6, 2011. The entire contents of these applications are incorporated by reference herein in their entirety.

FIELD OF INVENTION

This disclosure is generally related to devices and methods for providing a liquid to a human, for example, feeding of a human from another human's breast (or like structure).

BACKGROUND

Often, it is desired that a human provide nourishment, such as a feeding liquid, to a recipient, such as a human infant. On occasion, to provide sufficient nutrition to a recipient, it may be advantageous to augment or to replace, for example, a feeding liquid with another liquid. Such augmentation and/or replacement, may be of particular value to, for example, adoptive parents who may not possess breast milk, biological parents who may not have a sufficient quantity of natural breast milk, and biological mothers who may have undergone, for example, a mastectomy of one or both breasts. Breast-feeding, or a semblance thereof, may also be advantageous in that such activity may result, at least in part, in promoting closeness and bonding of a parent or other caregiver with an infant, or the like.

SUMMARY

Briefly, a fluid dispensing system embodying features of the invention may comprise a feeding device including at least one fluid housing for storing fluid and at least one dispensing portion fluidically coupled to the at least one housing to dispense the stored fluid to a recipient. In an embodiment including features of the present invention, the at least one housing is shaped to at least approximately conform to at least a portion of the shape of a human breast. In an embodiment including features of the present invention, a feeding device the at least one housing may be formed of a plurality of sub-housings. The plurality of sub-housings, may be fluidically connected in one or more locations. The sub-housings may have appropriate shapes such as those approximating petals. In an embodiment including features of the present invention, a feeding device may comprise a teardrop shape.

The human breast may be that of a male or female. It should also be understood that the devices and methods embodying features of the present invention are not limited to humans and the same may be useful in the care of other mammals such as chimpanzees. It should further be appreciated that different shapes and designs suitable for feeding devices embodying features of the present invention are within the scope of the present invention.

A dispensing portion embodying features of the invention may comprise an dispensing tip at a distal end thereof, fluidically coupled to at least one fluid feed chamber. The dispensing tip may include one or a plurality of apertures. In an embodiment, the dispensing tip may be configured to deliver fluid from the at least one housing and from a human breast to the recipient. In an embodiment, the dispensing tip may be configured to only, or substantially only, deliver fluid from the at least one housing (FIGS. 4A-4B) to the recipient. The dispensing portion, in an embodiment, is removably securable from the at least one housing. In an embodiment, the dispensing portion may be integral to the at least one housing. In an embodiment, the dispensing portion is fluidically connectable to the housing by way of any one or more of the fluid feed coupling, the inner ring chamber, and the ring output chamber, features of which will be describe in more detail with respect to the drawings . . . . In an embodiment, fluid from the at least once housing flows through a fluid feed channel and to the dispensing tip.

A fluid dispensing system embodying features of the invention may additionally comprise a feed channel that conveys fluid from the at least one housing to the dispensing tip. in an embodiment the feed coupling, may be positioned to on or off position to enable or disable fluidic connection between the feeding channel and the dispensing tip, respectively. In an embodiment, a device may include a removable material, materially and biochemically compatible with the fluid and the recipient, such as adhesive tape or a cover; which is disposable a the dispensing tip to minimize undesirable leakage when the device is not in use.

In an embodiment, at least a portion of a feeding device comprises a frustum shaped fluid channel portion coupled to one or more apertures for dispensing fluid to the recipient. In an embodiment, the dispensing tip may be coupled to the frustum shaped portion, or may be integrated with the frustum shaped portion.

In a fluid dispensing system embodying features of the invention, the housing may comprise a plurality of petal shaped sub-housings extending from an approximately central location, for storing fluid, the plurality of petal shaped chambers, together, at least partially, may approximate an oval or circular shape which approximately may conform to a shape of a human breast. In an embodiment, the plurality of petal shaped chambers are in fluid communication with one another.

In an embodiment, a fluid dispensing system embodying features of the invention may have a contour that approximately accords with a teardrop shape. A fluid dispensing system embodying features of the invention may additionally comprise an inner ring disposed at or near a bulbous portion of the teardrop shape. In an embodiment, one or structural members such as struts or reinforcing members may extend along a dimension of the housing or sub-housings (of the petal-shaped or teardrop designs). When present, such structural members may provide for additional structural integrity to the chamber and thus to the device, in particular when filled with fluid. The structural members may be formed from any material suitable, such as plastic, metal, or the like, and can be formed integral with the chamber (e.g., in the inner or outer surface of the housing or sub-housings) or removably insertable therein (or they may be disposed on an exterior surface of the housing similar to a cage). The structural members may extend in a suitable direction, as for example, along a longitudinal or transverse dimension of the housing. In an embodiment, the structural members may be in a helical, circular, or elongate configuration.

It should be noted that although petal or teardrop shaped housings/devices are described herein, other shapes suitable for storing and delivery of fluid and operating according to the principles of the present invention, are also within the scope of the present invention.

A fluid dispensing system may further comprise a ring output chamber for admitting fluid from the at least one housing to the inner chamber.

In an embodiment, the ring chamber and the associated output chamber and the corresponding dispensing port may be formed approximately concentric with the geometrical center of the housing.

In an embodiment, the ring the ring chamber and the associated output chamber and the corresponding dispensing port may be formed approximately non-centric with the geometrical center of the housing. In use, the non-centric configuration when worn by a caregiver, will be primarily located above the areola of the caregiver with the ring portion corresponding to and receiving the human nipple therein.

In an embodiment, the ring portion and the corresponding dispensing portion are configured for the natural nipple to extend therethrough, In an embodiment, the diameter of the ring portion and a base of the corresponding dispensing portion approximate the diameter of areola.

In an embodiment embodying features of the present invention, the dispensing form may be configured to also deliver natural milk from the human breast, concurrent or consecutive with delivery of fluid from the device.

A fluid dispensing system embodying features of the invention may additionally comprise an approximately helical shaped feeding channel that extends from an approximately outer circumferential location to an approximately central location. The helical-shaped device is formed to maintain approximately continuous contact with a human breast from the approximately central location to the circumferential location.

In some embodiments, a feeding device may be integrated into a brassiere to be worn by a caregiver and may include one or more housings for storage of fluids such as milk, formula, liquid supplements, or the like. The housing may be petal shaped and may conform or accord with a shape of a human breast, for example. In such embodiments, for example, fluids stored within petal-shaped sub-chambers may be warmed by caregiver's natural body heat prior to and/or during delivery to a recipient. One or more fluid dispensing apertures, which accord with a shape of a human nipple may be oriented at or near a medial portion of the dispensing portion of the feeding device.

The various components of the device, may be formed from same, similar, or different material. In an embodiment, the various components are formed from material approximating the human flesh and texture corresponding to the relevant component. By way of example, the housing/s, may be formed to have structural integrity, either independently, or as secured within or onto a clothing garment; while having pliability to approximate the pliability of the natural human breast. The choice of material will enhance the feeding experience.

In some embodiments, when it is desired that the infant only or at first receive natural milk from the caregiver's breast, the apertures at the distal tip of the dispensing portion may be either covered (or disabled from receiving fluid from the housing) The devices of the present invention provide for uninterrupted feeding of an infant, for example, until such time as the infant is satiated or any other appropriate time.

BRIEF DESCRIPTION OF DRAWINGS

Non-limiting and non-exhaustive features of the present invention are described with reference to the following figures, wherein like reference numerals refer to like parts throughout the various figures. As to organization and/or method of operation, together with objects (e.g., devices, assemblies, systems), features, and/or advantages thereof, claimed subject matter may best be understood by reference to the detailed description of drawings accompanied with the drawings, the summary, and the claims. The drawings are schematic presentations and not necessarily to scale.

FIGS. 4A-4B are a general schematic representation of a feeding device embodying features of the present invention and having an apertured dispensing tip;

FIG. 5 illustrates a petal-shaped feeding device embodying features of the present invention and having a detachably secured dispensing portion;

FIG. 6 illustrates a petal-shaped feeding device embodying features of the present invention and having an integral dispensing portion;

FIGS. 9-10 illustrate front and side views of a petal-shaped feeding device embodying features of the present invention and having a non-centric dispensing portion;

FIG. 11 illustrates a chambered feeding device embodying features of the present invention and including removably securable fluid dispensing portion;

Figure 1A:
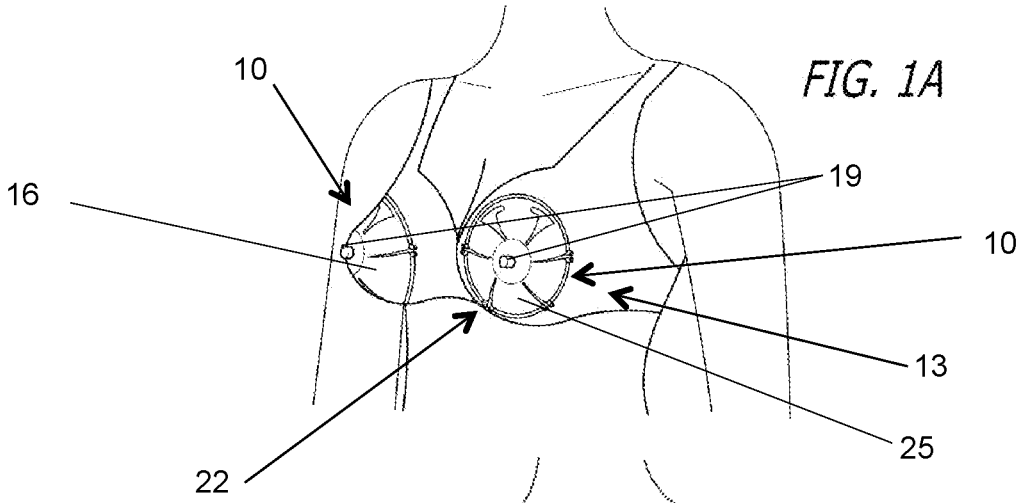
FIGS. 1A and 1B illustrate one or more feeding devices, embodying features of the present invention and integrated into a brassier.

Reference is made in the following detailed description to accompanying drawings, which form a part hereof, wherein like numerals may designate like parts throughout to indicate corresponding and/or analogous components. For ease of description and clarity of the drawings, like components may not have been numerically identified in all the drawings. It will be appreciated that components illustrated in the figures have not necessarily been drawn to scale, such as for simplicity and/or clarity of illustration. For example, dimensions of some components may be exaggerated relative to other components. Further, it is to be understood that various embodiments may utilize one or more of the features of other embodiments. Furthermore, structural and/or other changes may be made without departing from claimed subject matter. It should also be noted that directions and/or references, for example, up, down, top, bottom, and so on, may be used to facilitate discussion of drawings and/or are not intended to restrict application of claimed subject matter. Therefore, the following detailed description is not to be taken to limit claimed subject matter and/or equivalents.

DETAILED DESCRIPTION OF THE DRAWINGS

Reference throughout this specification to "one example," "one feature," "one embodiment," "an example," "a feature," "an implementation," or "an embodiment" means that a particular feature, structure, or characteristic described in connection with the feature, example, or embodiment is included in at least one feature, example, or embodiment of claimed subject matter. Thus, appearances of the phrase "in one example," "an example," "in one implementation," "an implementation," "an embodiment," or "in one embodiment" in various places throughout this specification are not necessarily all referring to the same feature, example, or embodiment. Particular features, structures, or characteristics may be combined in one or more examples, features, or embodiments. The term "user," "infant," and "individual" may be used interchangeably herein. The term "breast" as used herein may refer to one or more breasts of a male or a female human. The terms "fluid" and "liquid" may be used interchangeably herein.

A feeding device, and methods of using a feeding device, may be used by parents, caregivers, infants, and others by providing a means by which nutritious fluids, for example, may be dispensed. Thus, an individual wishing to nurse an infant, for example, may make use of a feeding device in a manner that may accord with natural, biologically-based infant feeding. A feeding device may be used by mothers who may wish to augment and/or replace natural breast milk with liquids having similar or superior nutritious content, additional vitamins, liquid medicines, etc. Nursing, by way of a feeding device, may be conducted in a manner that fosters bonding between an infant and a male or female caregiver, for example. In all the figures and descriptions, various embodiment as shown and/or as described may include one or more features of the present invention but not necessarily all the features.

Figure 1B:
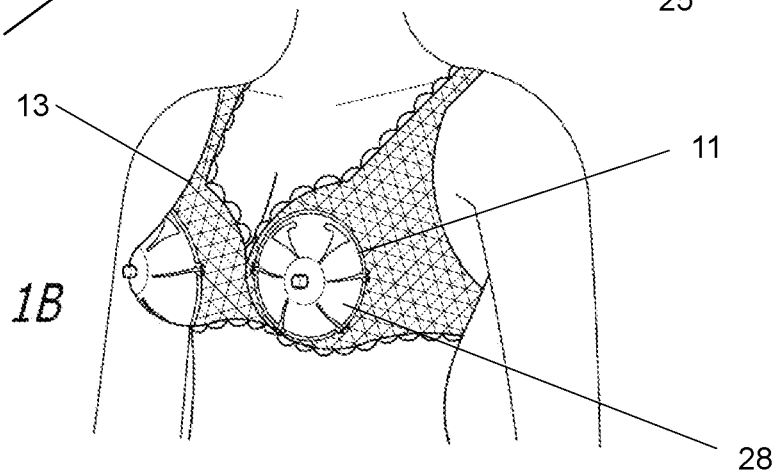

FIGS. 1A and 1B illustrate one or more feeding devices 10, defined in part by an outer perimeter 11, embodying features of the present invention and integrated into a brassiere. In FIG. 1A, brassiere 13 can be seen surrounding feeding device 10. The feeding device 10 includes a main fluid housing 16 and a fluid dispensing portion 19. In an embodiment as shown, the main fluid housing 16 is a multi-housing device 22 including a plurality of sub-housings 25 which are fluidically connected with one another. In an embodiment as shown, the sub-housings resemble petals 28, together forming the multi-housing device 22 which resembles a petal-shaped device. In an embodiment including features of the present invention, as shown and described below in reference to FIG. 7, the main housing is formed as a single housing (e.g., teardrop-shape embodiment described further below). FIG. 1B shows features similar to those shown in FIG. 1A, but with a more stylish brassiere 13. The feeding device 10 may be substantially and permanently integrated into the brassiere and/or may be configured to be detachable from the brassiere. In embodiments, multi-housing device 22 (e.g., petal-shaped or other suitable shapes and embodying features of the present invention) comprises one or more fasteners that may mate with or be received by features of brassiere 13, to enable the device to be securely fastened and/or supported by the brassiere such as, for example, by way of eyelets 110 (see FIG. 5) or by other means. Additionally, multi-housing feeding device 22 is shown as approximately conforming to the shape of a human breast. Accordingly, fluid stored within the feeding device may be naturally warmed by a caregiver's body temperature prior to and/or during dispensing to a recipient. Alternatively, the fluid may be warmed prior to being filled in the feeding device or be warmed while in the device prior to the feeding step using means similar to those used to warm liquid formula prior to dispensing to a recipient. The feeding devices embodying features of the present invention may be pre-filled, sterilized, and pre-sealed at a supplier (e.g. a supplier of formula or other nutrients) for future use by a caregiver 30. The feeding devices may be also be supplied empty for filling by the caregiver. Feeding devices may be configured for one time use and disposable, or may be configured for multiple uses and formed from material suitable for cleaning and sterilization (such as formula bottles and the like) using suitable means, including but not limited to, hot water, detergent, or microwave sterilization. In an embodiment, the feeding devices may be lined with a disposable liner (not shown) for receiving the fluid therein, minimizing the need for cleaning in between feedings, or being pre-filled and then being placed in the feeding device. Some or all of the parts of the feeding device, may be independently reusable or disposable, such as various components of the dispensing portion 19 and the sub-housings 25. It should be noted that other shapes of chambers and/or fluid housing is within the scope of the present invention. The dispensing portion 19 may be permanently affixed or formed integral with the fluid housing 16, or may be removably securable to the fluid housing.

Feeding devices embodying features of the present invention may also be configured to be self-adhering to the human body, as for example, brassieres formed from silicon material and which may be provided as a kit comprising different lobes/cups (separate or connected). The devices of the present invention may also be securable to the body by way of tapes, adhesives and the like. The feeding device and its various components may be formed from suitable material, such as those used for storage of liquid formulas, food pouches, and the like. In an embodiment, the material may be chosen to be suitable for injection molding or other forms of molding or 3D printing for ease of manufacture.

Figure 2:
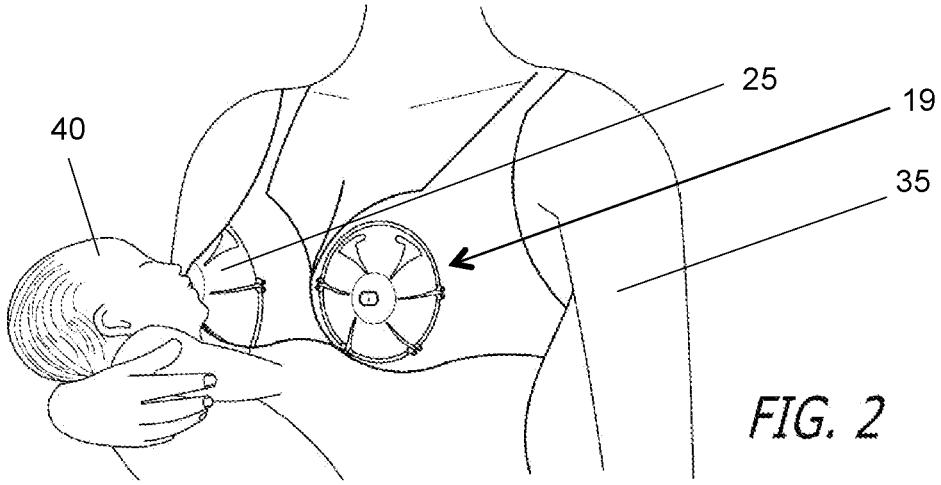
FIG. 2 illustrates an infant and caregiver using a feeding device, embodying features of the present invention.

FIG. 2 illustrates the caregiver 35 using the feeding device 10 to feed a recipient, such as an infant 40. In FIG. 2, although infant 40 is shown having a particular size relative to a caregiver 35, it should be noted that recipients (e.g., infants) who may receive fluid from a feeding device may be larger in size or smaller in size than the infant. Accordingly, the infant 40 represents merely one type of recipient, and claimed subject matter is not limited in this respect. A recipient may be a human recipient, e.g., human infant, or another mammal, such as a chimpanzee (not shown).

FIGS. 3A-3D are general schematic representations of one or more cross-sections of portions of feeding devices embodying features of the present invention, in an unfilled (unexpanded configuration—with none or substantially no fluid).

Figure 3A:
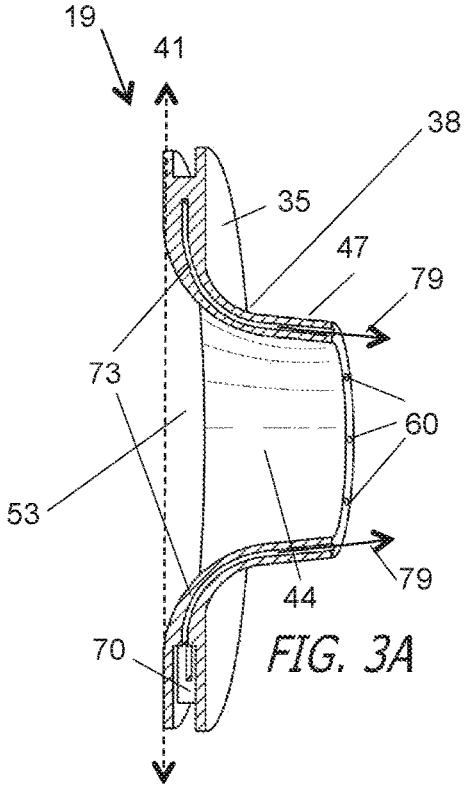
FIGS. 3A-3D are general schematic representations of one or more cross-sections of feeding devices embodying features of the present invention.
Figure 3B:
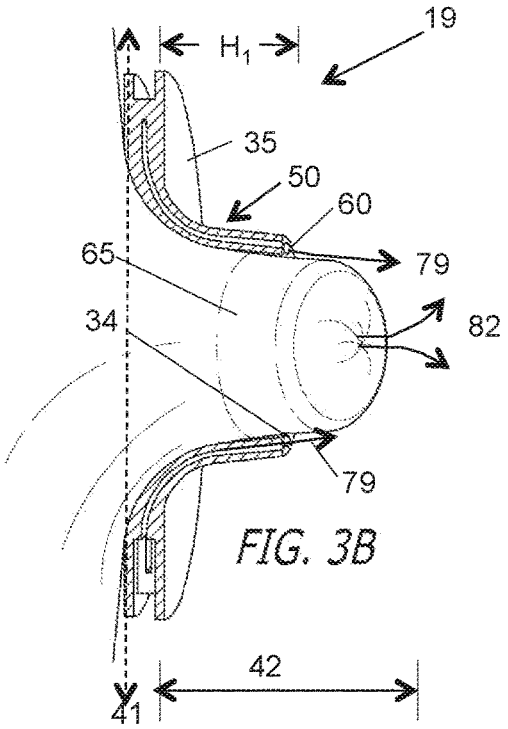

FIG. 3A as illustrated includes the fluid dispensing portion 19, embodying features of the present invention and comprising a predominantly horizontally-oriented disc-shaped shell 35 having a frustum-shaped fluid channel portion 38 which extends in a relatively perpendicular (or slightly sloped inward) direction from an imaginary base 41 of the shell 35. The frustum-shaped fluid channel portion 38 has a height 42 (H1 as shown in FIG. 3B), forming a lumen 44 near a medial portion of shell 35, and terminating in a fluid dispensing tip 47 at a distal end 50 of the dispensing portion. The base of the frustum shaped fluid channel portion 38 may be approximately flush with the imaginary base 41 base or slightly raised above it.

A cavity 53 defines a space formed between a top layer 56 and a bottom layer 59 of the shell 35. In an embodiment, the cavity 53 is expandable as it is filled with fluid. The shell 35 may be configured such that the dimension between the top and bottom layers (cavity 53 and fluid channel 38) varies between the outer perimeter 11 of the feeding device 10 and the base 41 of the dispensing portion 19. This configuration may be achieved by suitable means, including but not limited to, independently or relatively, varying the thickness of the top and bottom layers along the radial dimension between the outer perimeter 11 and the base 41, or forming the top and/or bottom layers, independently or relatively, from different material in the radial direction (although integral with one another).

The layers may be formed from the same or different, but compatible material. By way of example, when formed from different material, the bottom layer which would come in contact with the breast is formed from material suitable for such contact while the top layer may be formed from a material suitable for contact with the infant's mouth. The top layer, itself, may be formed from a single or different, yet compatible, materials. By way of example, the top layer at the dispensing portion may be formed from material more suitable for contact with the infant's mouth and closer in texture to human nipple (e.g., formula bottle nipples).

The fluid dispensing tip 47 includes apertures 60 formed in the otherwise uninterrupted material of top layer 56.

The lumen 44 extending in the frustum-shaped fluid channel 38 and having the height 42, is configured to at least partially surround and receive a human nipple 65.

As shown in FIGS. 3A-3D, the distal end 50 of the dispensing portion 19 is truncated creating an open distal end 68 through which a human nipple may come in direct contact with the infant's mouth. It should be noted that the top layer 56 is uninterrupted except for the apertures 60 formed in the material thereof. In an embodiment, for greater fluid flow, the apertures 60 may form a single continuous aperture.

A fluid feed coupling 70 provides a sealable conduit for receiving fluids from at least a portion of the fluid housing 16 (FIG. 1) and conveying the fluid into a fluid feed chamber 73 within a portion of the cavity 53 (cavity formed between the top and bottom layers 56 and 59, respectively) located at the base 41 of the dispensing portion.

The fluid feed chamber 73 dispenses the fluid to the infant through the one or more dispensing apertures 60 formed in the material of the top layer 56, at the fluid dispensing tip 47. As provided earlier, through the choice and design of the material, the width (dimension between top and bottom layers) of the cavity and the fluid feed chamber may vary.

The feeding device, in an embodiment as shown in FIG. 5, may include a ring output chamber 103 (the ring output chamber included in an inner ring chamber 100 formed in the housing 16 and proximate the imaginary base 41) corresponding to fluid feed chamber 73. The ring portion 100 approximates the areola area of the breast.

The feed chamber 73 and the corresponding ring output chamber 103 may be formed integral (FIG. 6) with one another (as when the main housing 16 and dispensing portion 19 are integrally formed with one another); or the feed chamber 73 may be formed in the dispensing portion 19 and configured to be removably engagable with the ring output chamber 103 by suitable means, such as, but not limited to, snap and fit (as when the housing 16 and dispensing portion 19 are removably secured with one another).

Now referring to FIGS. 3A-3D, fluid feed coupling 70 may include self-sealing provisions which may enable secured filling of the feed chamber 73.

Feed chamber 73, as shown in FIG. 3A, is in the unexpanded state (unfilled with liquid) and may be expanded as fluid is delivered through the fluid feed coupling 70, through chamber 73, for delivery to the dispensing apertures 60 at the distal end of the fluid dispensing tip 47 and to a recipient as shown by arrows 79.

Apertures 60, at least some of which are shown in FIG. 3A, may provide a means for dispensing nutritious fluids, such as liquefied vitamins, formula, and so forth, to the infant from the feed chamber 73.

Thus, although not shown in FIG. 3A, additional arrows similar to arrows 79 can be envisioned as emanating from apertures 60 to indicate fluid flow from chamber 73 to the infant. Although in FIG. 3A a few apertures are shown, embodiments may include fewer or more apertures, such as one or two, or a multicity of apertures, such as 10, 15, 20, or more, and claimed subject matter is not limited in this respect. The one or more apertures, independently, may also vary in diameter (thus vary in delivery and flow rate). In an embodiment, if a more unrestricted flow is desired the apertures 60 may form a single continuous aperture.

In the embodiments shown in FIGS. 3A-3D, the apertures 60 formed in the top layer are distributed around a circumference of distal tip 47. As can be seen in FIG. 3B, first and second of apertures 60 are located immediately superior and immediately inferior, respectively, to the portion of natural (e.g., human) nipple 65 that protrudes through open distal end 68.

In the embodiment shown in FIGS. 3A-3D, fluid from the one or more apertures 60 may be permitted to be delivered with natural milk from the nipple 65 for dispensing to the infant, the flow of which is represented by arrows 82. It should be appreciated that the word dispensing is not limited to positive pressure dispensing and it may include dispensing by pressure, suction, gravity, and the like, and that the fluid may be delivered to or received or taken in by the infant.

The dispensing portion 19 embodying features of the present invention and as shown in these figures, may be of particular use when the caregiver's natural supply of breast milk, for example, becomes depleted during feeding or is unavailable all together. Accordingly, the natural breast milk such as that from nipple 65 may be augmented by additional fluids delivered through the one or more apertures 60. It should be appreciated that depending on the need, the device may be configured such that fluid from the device or the natural breast is dispensed, concurrently, or consecutively, or may be totally delivered from the device (as for example when breast milk is substantially or completely unavailable). By way of example, a caregiver may wish to have the infant first feed primarily from the natural breast before engaging the fluid feed coupling 70 to the "on" position to also provide fluid from the device. For the purposes of discussion, the fluid feed coupling 70 may be configured to be always in the on position (e.g., to have the fluid housing 16 and the dispensing portion 19 in fluidic communication, or be manually placed in an "engaged" or "on" position to enable such fluid communication, or disengaged or in "off" position to disallow fluidic communication). In an embodiment, the on/off configuration may be achieved automatically based on the flow rate and/or volume of the fluid.

Figure 3C:
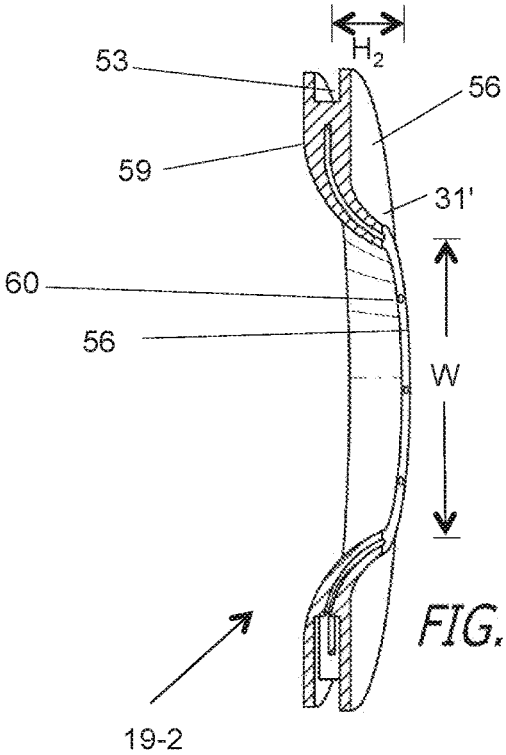
Figure 3D:
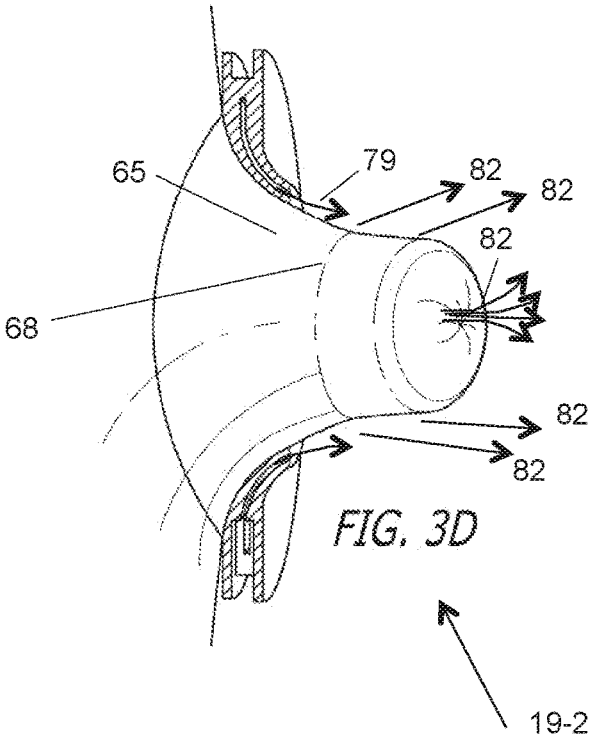

FIGS. 3C-3D illustrate a feeding device embodying features of the present invention and similar to that of FIGS. 3A-3B having a dispensing portion 19-2. While the frustum-shaped fluid channel portion 38 of FIGS. 3A-B has a height 42 with a dimension represented as H1, the frustum-shaped fluid channel portion 38 of FIGS. 3C-D has a height 42 with a dimension represented as $H_2$, indicating a shorter height H2 as compared to the height H1. Accordingly, as shown in FIGS. 3C-D, nipple 65 may be exposed to a larger extent than the nipple of FIGS. 3A-B. In some embodiments, exposure of a larger portion of the nipple 65 may enable the infant to receive a larger portion of natural milk, as indicated by arrows 82, from the caregiver (from nipple and areas surrounding the nipple). In addition, devices embodying features of the present invention and as shown in FIGS. 3C-3D may provide for a greater contact with the areola during the feeding process. It should be noted that the diameter (W) of the distal tip may vary and as such, enable less or more contact with the areola. Similarly, by varying the diameter W and the height 42 of the frustum, the device may be suited to different caregivers with different breast sizes and shapes.

The general schematic representations of FIGS. 3A-3D illustrate, at least in part, how a frustum shaped portion of a feeding device may be of variable height and width, with varying numbers and sizes of apertures, which may result, at least in part, in enabling delivery of varying proportions of contact with the areola/natural nipple and/or delivery of breast milk (as well as being suitable to different breast sizes and shapes). In at least some instances, protection of sensitive areas of a breast, by way of greater H1 or smaller W, may reduce discomfort associated with feeding an infant, thereby enabling a more comfortable feeding experience FIGS. 4A-4B are general schematic representations of a dispensing portion 19-3 of a feeding device embodying features of the present invention and similar in some respects to those shown and/or described in reference in FIGS. 3A-3B. In the devices shown in FIGS. 4A-B, a shell 35, is configured to at least completely enclose the natural nipple 65 which is to be received in the lumen 44. The fluid feed chamber 38, in contrast to FIGS. 3A-3D, does not have an open distal end at the dispensing tip 47, rather it is configured to surround the natural nipple 65 when received therein. Fluid from the housing may be delivered to apertures 60 formed in the distal tip 47 in a manner similar as that described with respect to FIGS. 3A-3C. In the configuration of the device embodying features of the present invention shown in FIGS. 4A-B, the device may be the only source of fluid for the infant, as the distal end 50 does not expose the nipple 65.

Similarly, the dispensing portion 19 may interact with the main fluid housing 13 in the same manner as that described in relation to FIGS. 3A-3D, e.g., integral therewith, or securely removable.

Fluid flow from chamber 38 through apertures 60, in FIGS. 4A-4B, is represented by arrows 79. As shown, nipple 65 may come into intimate contact with inner walls of the frustum shaped fluid channel 38. In an embodiment, the design of the embodiment enables a vacuum to be created by the infant, for example, as suckling from apertures 60 at a distal end of the dispensing tip. As can be seen in FIG. 4B, fluid may be drawn from fluid feed chamber 73, past nipple 65, and out from apertures 60. This configuration may be of particular use when intimate contact between the mouth of the infant and the nipple of the caregiver giver is not desired.

FIG. 5 illustrates a feeding device 10-3, having a fluid housing 16 formed from multiple sub-housings 25 (in the form of petals), and embodying features of the present invention and having a detachably secured dispensing portion 19. In FIG. 5, the dispensing tip 47 is shown as including at least two apertures 60. The embodiment shown, although shown with a dispensing portion similar to that in FIGS. 4A-B, can equally be designed with the dispensing portion similar to that in FIGS. 3A-D.

In some embodiments, sub-housings 25 of feeding device 10-3 may be fluidically interconnected thereby allowing the sub-housings of the feeding device to be in fluid communication with one another. Thus, when filling a feeding device 10-3, such as, by way of a fluid input port 90, the port may enable the filling of several sub-housings. In an embodiment, one or more of the sub-housings may have one or more fluid input ports 90, independently fillable. In an embodiment of a device embodying features of the present invention, there may be markers incorporated into the material or device to ease with identification of the level of fluid in the housing.

In implementations embodying features of the invention, the input port 90, such as a single fluid input port 90 may be disposed at a location, which in use, is closer to the caregivers head. Accordingly, fluid may be filled into the housing or multiple sub-housings and allowed to pool near a lower portion of the feeding device as a fluid supply is depleted. The filling may be achieved by suitable means, such as gravity or pressure.

In FIG. 5, an inner ring chamber 100, corresponding to the areola area, receives fluid from the fluid housing 16 of the feeding device (although inner ring 100 is shown in a central location of the housing, in some embodiments, the ring is non-centric with respect to the fluid housing). The ring 100 includes a ring output chamber 103 and an output coupling 106 which facilitates the flow of fluid from the fluid housing 16 (or from the one or more sub-housings 25) to the ring output chamber 103. Fluid flow to the fluid feed chamber 73 in the dispensing portion 19 may be regulated by fluid feed coupling 70 as described earlier.

In the embodiment, as shown in FIG. 5, the dispensing portion 19 (including the feed chamber 73) is detachably secured to the fluid housing. In an embodiment as shown, the ring output chamber 103 and feed chamber 73 are detachably secured to one another.

It should be noted that one or more internal fluid ducts (not shown) may be formed in the inner surface of the material forming the housing or sub-housings to enhance the flow of delivery of fluid from the housing or sub-housings to the fluid inner ring chamber 100, and claimed subject matter is intended to embrace any number of internal input ducts.

In an embodiment, as shown in FIG. 6 and including features of the present invention, the dispensing portion 19 (including the feed chamber) is formed integral with the fluid housing as described above. In the embodiment described, the inner ring chamber 103 and feed chamber 73 are integral to one another (not shown). The manufacture of such configuration, may, for example, be achieved by injection molding to facilitate and minimize number of parts. In an embodiment of the integral configuration, the fluid feed coupling 70 and ring output coupling 106 may be one and the same. The embodiment shown, although shown with a dispensing portion similar to that in FIGS. 4A-B, can equally be designed with the dispensing portion similar to that in FIGS. 3A-D.

One, two, or no couplings (whether feed coupling 70 or ring output coupling 106) may be used in various configurations depending on the level of flow control desired. In an embodiment, there is only one fluid coupling which can turn the fluid communication between the housing 16 and the dispensing portion 19 on and off by suitable means, such as but not limited to, rotation of the dispensing portion about the ring 100 (e.g., partial clock and/or counterclockwise rotation), and the like.

Figure 7:
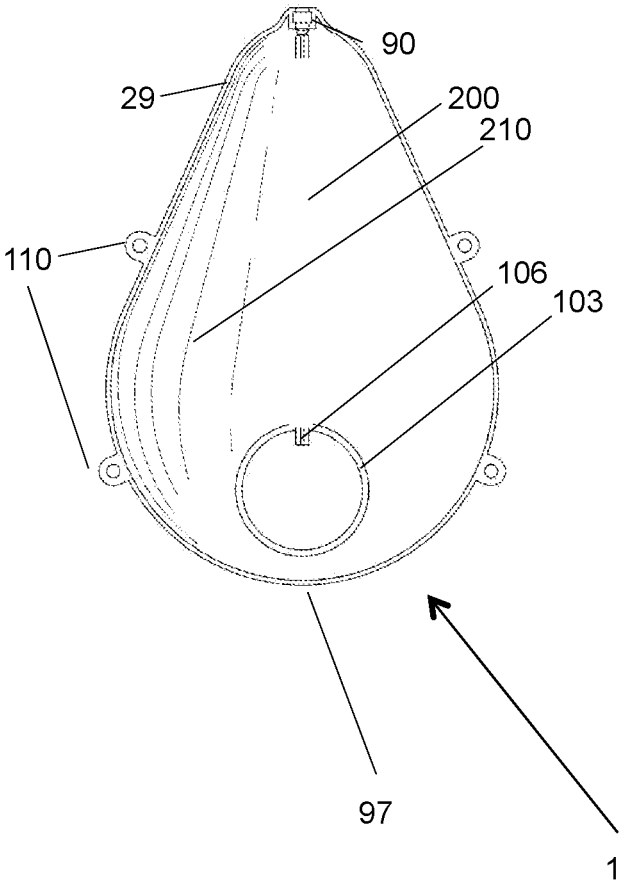
FIGS. 7-8 illustrate front and side views of a teardrop-shaped feeding device embodying features of the present invention.
Figure 8:
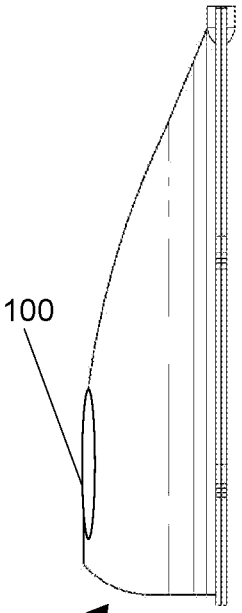

FIGS. 7-8 illustrate front and side views of a feeding device 10-4 embodying features of the present invention and similar in some respects to those shown and/or described in reference to FIGS. 3A-D, 4A-B, and 5-6, and having a generally teardrop-shaped fluid housing 29 with an interior 200. For ease of description, the dispensing portion is not shown. In FIG. 7, fluid may be introduced into the interior 200 via fluid input port 90.

The dispensing portion (not shown) may be securably detachable from the fluid housing at the inner ring 100 and fluidically connectable to the interior 200 by way of ring output coupling 106 and fluid feed coupling 70 of the dispensing portion 19 (not shown). The dispensing portion (not shown) may also be formed integral with the main fluid housing, as described above. In a tear-shaped device embodying features of the present invention and as shown, the ring portion 100 approximates the areola area. In use, a most inferior portion of the device rests slightly below the areola, while the majority of the housing rests above the ring portion. In this configuration, when the device is secured to a clothing item by way of eyelets 110, the design minimizes the undesirable effects of gravity on the device and its fluid content. The embodiment shown, although shown with a dispensing portion similar to that in FIGS. 4A-B, can equally be designed with the dispensing portion similar to that in FIGS. 3A-D.

Functional features of the device of FIGS. 7-8 may be similar to petal-shaped feeding device designs previously described above. In some embodiments, the teardrop shaped feeding devices, features of which are shown in FIGS. 7-8, may include structural members 210 which may be present in the interior 200 or exterior of the feeding device. The structural members 210 may be formed integral with the internal (or external) surface of the housing or may be insertable for disposal therein. The structural members 210 may extend along a longitudinal axis or run in a transverse direction to the housing. The use of structural members 210 may provide enhanced structural integrity to the device and permitting the feeding device to retain an approximate teardrop shape as the fluid from its internal chamber is exhausted. In an embodiment, the teardrop-shaped feeding device may be positioned on the breast such that ring portion 100 receives the areola and the nipple (e.g., nipple 65 of FIG. 3B). In use, in the embodiment shown, fluid input port 90 which is shown superior to ring portion 100, may be oriented in the direction of the caregiver's head. Eyelets, such as eyelets 110, may be employed to secure the feeding device to a brassiere or other articles of clothing in a manner similar to that shown in FIGS. 1A and 1B. Structural members may also be present in other housing portions, as in petal-shaped devices discussed above. By way of example, one or more structural members may similarly be present in/or the sub-housings 25/28.

FIGS. 9-10 illustrate front and side views of a petal-shaped feeding device 10-6 embodying features of the present invention and having a removably securable dispensing portion 19, including a fluid input port 90 and dispensing tip 47 (shown in top view). It should be noted that in the device of FIG. 9-10, the ring portion 100 is non-centric with respect to the geometrical center of the fluid housing 16-6. As shown, the ring portion 100, is located proximate an outer periphery of the device in a non-central position. In use, the ring portion approximates the areola area and the most inferior portion of the device rests slightly below the areola while the majority of the device rests above the ring portion (and the areola). In this configuration, when the device is secured by way of eyelets 110, the design minimizes the undesirable effects of gravity on the device and its fluid content. The ring area corresponding to a geometric central area of the fluid housing has been shaded differently to further clarify the non-centric ring as shown (as well as when the ring is concentric with the housing in other embodiments). The embodiment shown, although shown with a dispensing portion similar to that in FIGS. 4A-B, can equally be designed with the dispensing portion similar to that in FIGS. 3A-D.

Figure 12:
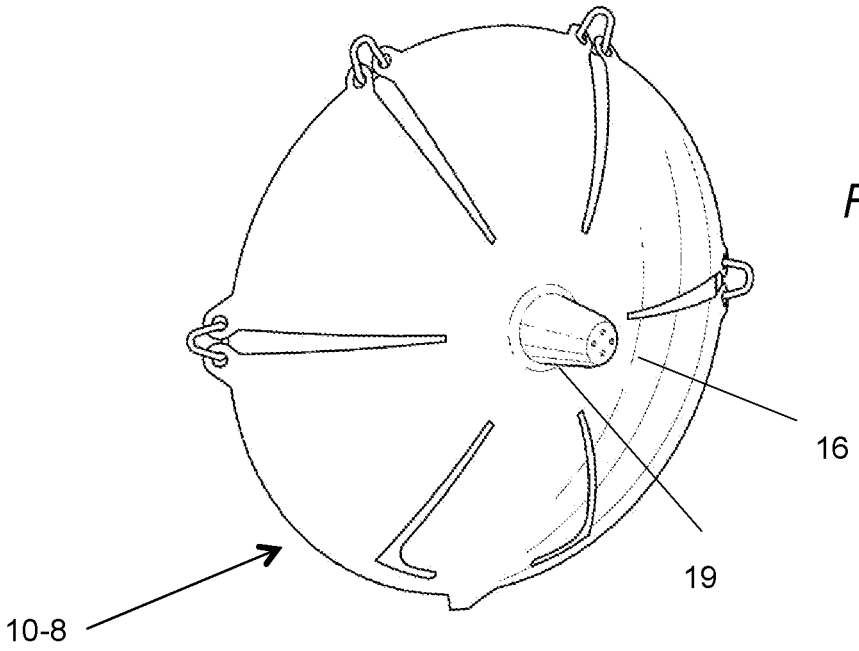
FIG. 12 illustrates a chambered feeding device embodying features of the present invention with integral fluid dispensing portion.

FIGS. 11 and 12, respectively, illustrates side views of a device having petal-shaped sub-housings 28, including a removably securable dispensing portion 19-7 and an integral dispensing portion 19-8, respectively, features of which were described earlier above. The embodiment shown, although shown with a dispensing portion similar to that in FIGS. 4A-B, can equally be designed with the dispensing portion similar to that in FIGS. 3A-D.

Figure 13:
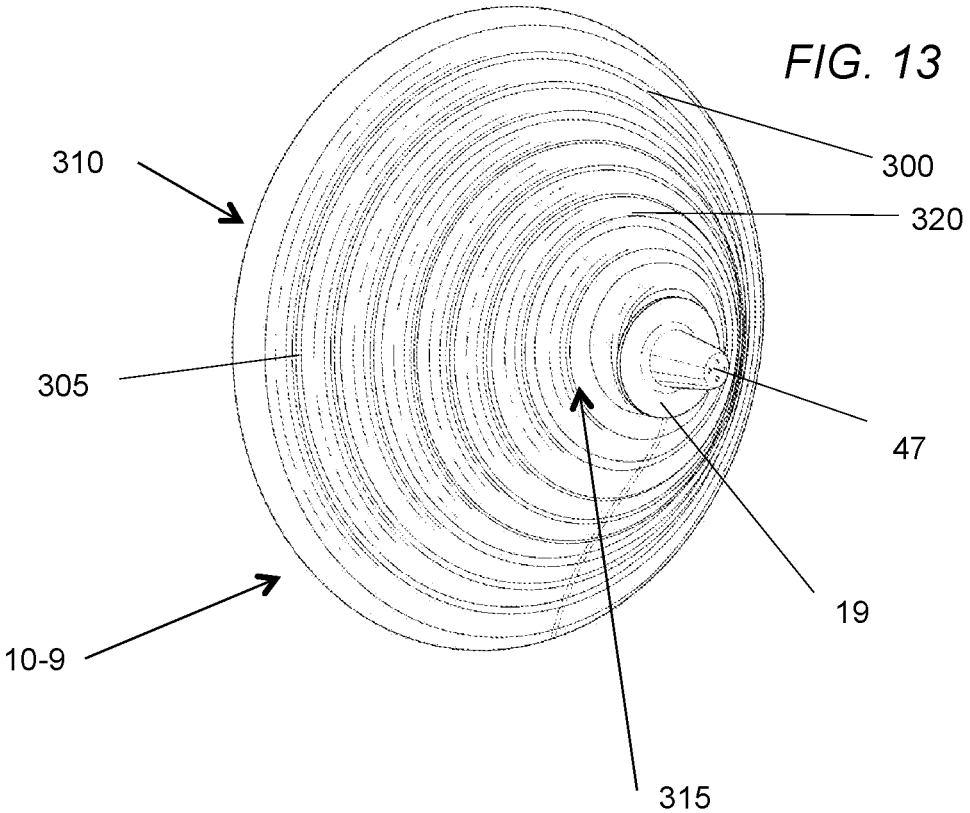
FIG. 13 illustrates a helical shaped feeding device embodying features of the present invention and having a fluid dispensing portion.

FIG. 13 illustrates a helical shaped feeding device 10-9 embodying features of the present invention and including a housing 16-9 and dispensing portion 19-9. The embodiment shown, although shown with a dispensing portion similar to that in FIGS. 4A-B, can equally be designed with the dispensing portion similar to that in FIGS. 3A-D.

The device of FIG. 13 includes fluid channels 300 which approximate a helical design. In an embodiment, the device may comprise a tubular member (formed from a single tubular member or multiple tubular members which are fluidically connected to one another) and which is formed in the shape of a helix (or approximate thereof) 305. The fluid travels from an approximately outer circumferential location 310 to an approximately central location 315 prior to travelling through the dispensing portion 19. The dispensing portion, may be either centric with the device or off-centered, as described with respect to the previous figures. In an embodiment, the housing 16 may have suitable material 320 formed between the helical channels 300 (such as the membrane formed between the fingers of a bat). In an embodiment, the helial tubular member may be partially or completely covered by a suitable membrane (such as silicon or other suitable material). In an embodiment, the housing has a helical design formed directly in the material forming the housing.

Thus, although particular illustrative embodiments are described, it is intended that this specification and claimed subject matter be interpreted reasonably broadly. For example, claimed subject matter is believed to include a feeding device that may be employed to dispense nutritious foods to recipient, such as an infant, for example. Through the use of such a device, nutritious fluids may be comfortably dispensed by a caregiver while fostering a bonding experience between a caregiver and an infant.

While there has been illustrated and/or described what are presently considered to be example features, it will be understood by those skilled in the relevant art that various other modifications may be made and/or equivalents may be substituted, without departing from claimed subject matter. Additionally, many modifications may be made to adapt a particular situation to teachings of claimed subject matter without departing from one or more central concept(s) described herein. Therefore, it is intended that claimed subject matter not be limited to particular examples disclosed, but that claimed subject matter may also include all aspects falling within appended claims and/or equivalents thereof.

What is claimed is:

1. A fluid dispensing system comprising:

a. at least one housing for storing fluid;

b. at least one dispensing portion comprising two layers, each layer having an inward and an outside surface;

c. at least one conduit fluidically connecting the at least one housing to the at least one dispensing portion;

d. at least one dispensing aperture formed in the dispensing portion for dispensing the fluid to a recipient; and e. at least one fluid channel disposed between the inward surfaces of the two layers of the at least one dispensing portion and extending from an inlet of the dispensing portion to the at least one aperture.

2. The fluid dispensing system of claim 1, wherein the at least one fluid channel is configured to dispense the fluid in response to suction applied by the recipient to the dispensing portion.

3. A fluid dispensing system, comprising:

a. at least one housing for storing fluid disposable at a caregiver's breast;

b. at least one dispensing portion having at least one dispensing aperture formed in the dispensing portion for dispensing the fluid to a recipient in simultaneous intimate contact with the at least one aperture and at least a portion of the care-giver's nipple;

c. at least one fluid feed channel formed by an inward surface of an inner layer of the dispensing portion and extending from an inlet of the dispensing portion to the at least one aperture; and d. at least one conduit fluidically connecting the at least one housing to the dispensing portion.

4. A fluid dispensing system for placement adjacent a first person's breast, comprising:

a. a dispensing portion configured to at least partially surround the first person's nipple and comprising a first layer and second layer each layer having an outer surface and inner surface configured to face the inner surface of the other layer, the outer surface of the second layer configured for direct contact with the first person's nipple;

b. at least one fluid channel formed between the inner surfaces of the first and the second layers;

c. at least one fluid conduit for fluidically connecting the dispensing portion to a source of fluid; and d. at least one dispensing aperture formed in the dispensing portion for dispensing the fluid to a recipient.

5. The fluid dispensing system of claim 4, wherein the dispensing portion first and second layers form a base configured for resting against the first person's breast and a tubular projection extending from the base and configured for receiving the first person's nipple therein.

6. The fluid dispensing system of claim 5, wherein the tubular projection has a distal end which at least partially covers the first person's nipple.

7. The fluid dispensing system of claim 5, wherein tubular projection has an open distal end.

8. The fluid dispensing system of claim 6, wherein the at least one dispensing aperture is formed in the tubular projection distal end.

9. The fluid dispensing system of claim 7, wherein the at least one dispensing aperture is formed in the tubular projection open distal end and at least partially surrounds the first person's nipple.

* * * * *